US007735762B2

(12) United States Patent
Jonkka

(10) Patent No.: US 7,735,762 B2
(45) Date of Patent: Jun. 15, 2010

(54) KNIFE SYSTEM FOR A DISC CHIPPER

(75) Inventor: Arvo Jonkka, Pori (FI)

(73) Assignee: Metso Paper, Inc., Helsinki (FI)

( * ) Notice: Subject to any disclaimer, the term of this patent is extended or adjusted under 35 U.S.C. 154(b) by 0 days.

(21) Appl. No.: 12/635,260

(22) Filed: Dec. 10, 2009

(65) Prior Publication Data

US 2010/0090048 A1 Apr. 15, 2010

Related U.S. Application Data

(63) Continuation of application No. PCT/FI2008/050269, filed on May 13, 2008.

(30) Foreign Application Priority Data

Jun. 13, 2007 (FI) ..... 20070467

(51) Int. Cl.
*B02C 19/00* (2006.01)

(52) U.S. Cl. ..... 241/92; 144/176

(58) Field of Classification Search ..... 241/92; 144/176

See application file for complete search history.

(56) References Cited

U.S. PATENT DOCUMENTS 5,857,508 A 1/1999 Jonkka
5,996,655 A 12/1999 Cramond et al.
6,056,030 A 5/2000 Jonkka
2003/0019543 A1 1/2003 Schuh et al.
2005/0081956 A1 4/2005 Haapasalo
2005/0211339 A1 9/2005 Jonkka

FOREIGN PATENT DOCUMENTS

WO WO 90/15702 A1 12/1990
WO WO 98/01272 A1 1/1998
WO WO 03/068467 A1 8/2003

OTHER PUBLICATIONS

International Search Report for PCT/FI2008/050269 completed Sep. 1, 2008.
Written Opinion for PCT/F12008/050269 completed Sep. 1, 2008
Finnish Search Report for FI 20070467 completed Jan. 24, 2008.

*Primary Examiner*—Mark Rosenbaum
(74) *Attorney, Agent, or Firm*—Buchanan Ingersoll & Rooney PC

(57) ABSTRACT

A knife system of a disc chipper, the knife in said system being clamped to its operation position between a wear plate and a press block. The wear plate is supported to the knife disc adjustably for the inclination with respect to the surface of the knife disc. The adjustability is provided by means of a hinge and an adjustment strip. The hinge strip is located adjacent a knife and the adjustment strip is located at the next chip opening. A convergent space is provided for the adjustment strip. The adjustment strip is correspondingly wedge-shaped and has a position adjustable and locking means.

8 Claims, 4 Drawing Sheets

KNIFE SYSTEM FOR A DISC CHIPPER

Figure 1:
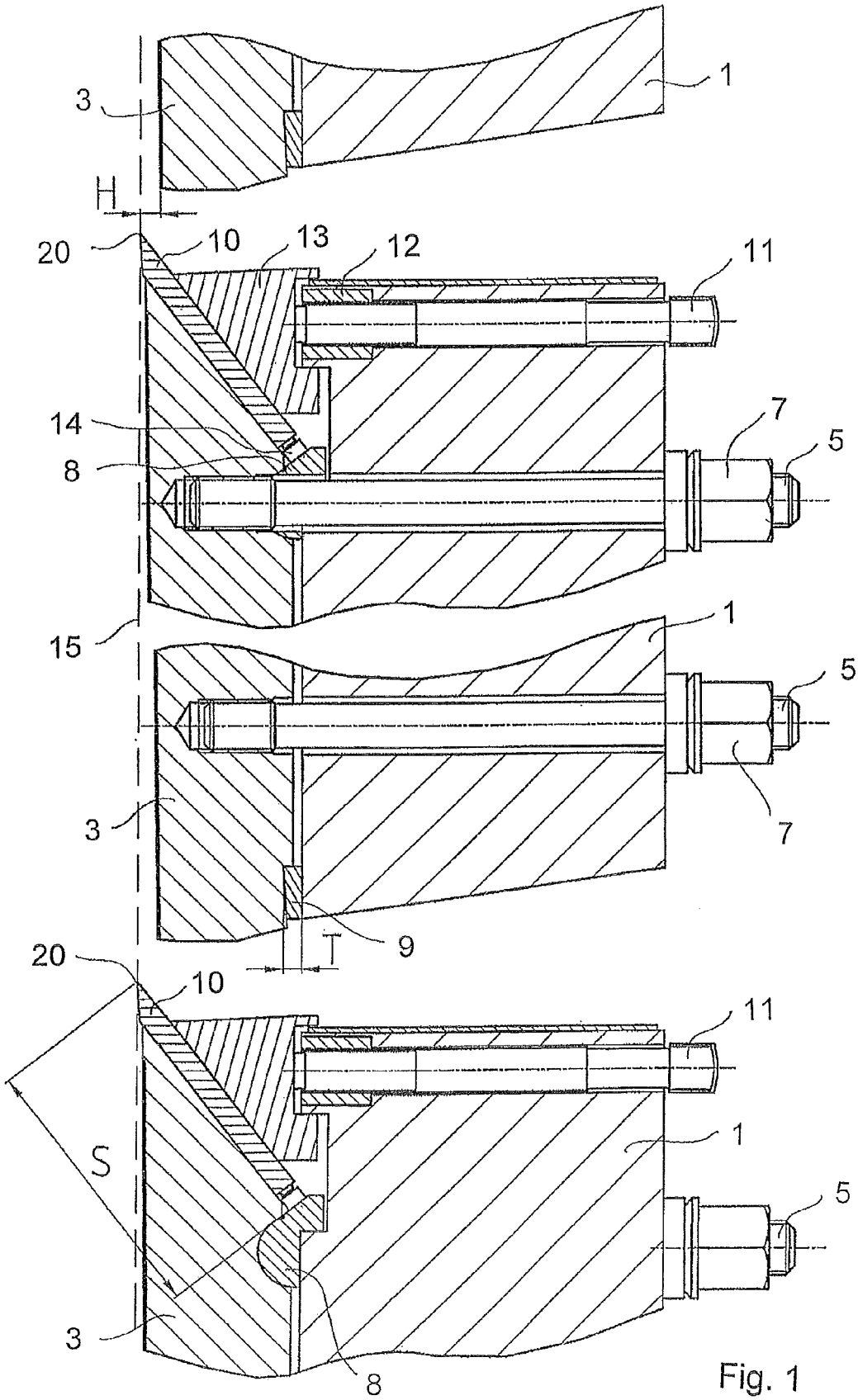
Fig. 1 Prior Art

The present invention concerns a knife system for a disc chipper, by means of which the projecting position of the tips of the cutting edges of individual knives can be adjusted relative to the knife disk.

Disc chippers are widely used for producing chips to be used for the pulp manufacture. The knife disc of the disc chipper is provided with knives arranged in about a radial direction, said knives chipping the wood against an immovable counter knife. For the part of the chipper, the chip quality is effected by the condition of the counter knife, bearings of the knife disc, adequate stiffness of the chipper parts, correctly sharpened knives with correctly adjusted width and a small clearance between the knives and the counter knife. In relatively large disc chippers used nowadays, also the planarity of the tip position of the knife cutting edge is a significant factor for the good chipping result. The planarity means that the tips of the knife cutting edges are at the same level in the perpendicular direction to the axis of the chipper. An absolute prerequisite for the successful adjustment of the knife clearance, in other words, the distance between the counter knife and the chipping knives, is the minimum deviation of the knife cutting edge tips from this level.

The positions of the knife cutting edge tips are based on the manufacturing tolerance of the chipper parts and the correct adjustment of the width of the knives. Because the modern knife systems of chippers include many parts, even small manufacturing inaccuracies can cause big differences as they multiply. The differences even increase, when the parts come from different series of manufacture. Even if the width adjustment has been made carefully, whereby the mutual width difference between knives ranges +/−0.1 mm, there are differences between the positions of the knife cutting edge tips when the knives are attached to the knife disc. Thus, the position differences between the knife cutting edge tips often range between 0.5-1.0 mm and lead, especially with certain wood species, to a prominent formation of strings. Strings are formed from the surface wood, when the knife clearance is bigger than normal. The knife is not able to cut off the tough surface wood, and the strings are drifted between the counter knife and the knife to the periphery of the knife disc, and from there further among the chips.

By means of the present invention, the influence of the manufacturing inaccuracy can be compensated, and the cutting edge tips of the knives can be positioned substantially more exactly than in traditional chippers to the same level in the knife disc of the chipper. The invention will be implemented by means of a chipper provided with wear plates on the knife disc, said wear plates covering the knife disc surface facing towards the logs to be chipped, between the chip openings adjoining the cutting knives. The wear plates have an adjustable inclination with respect to the surface of the knife disc, i.e. with respect to a plane perpendicular to the axis of the disc. Wear plates with an adjustable inclination are used for controlling the chip length in a chipper. A drawback with said wear plates is that, the knife cutting edge tips tend to set at different distances from the disc surface of the chipper even more often than in chippers with firmly attached wear plates. There can also be differences in the projection of the cutting edge tip in a single knife, in other words, the projection at the inner circle can be different from the projection at the outer circle. A disc chipper and an adjustable wear plate of prior art are described for instance in the U.S. Pat. No. 6,056,030.

In accordance with the teaching of said publication, the position of the adjustable wear plates defining the chip length is adjusted by means of adjustment strips having different thicknesses.

By means of the knife system in accordance with the invention, the inclination of the wear plate clamping a knife can be adjusted so that the tip of the cutting edge of the knife is in a plane common with the other knife cutting edge tips, the plane being perpendicular to the shaft of the knife disc. The knife system in accordance with the present invention is defined in more detail in the enclosed Claim 1.

Figure 2:
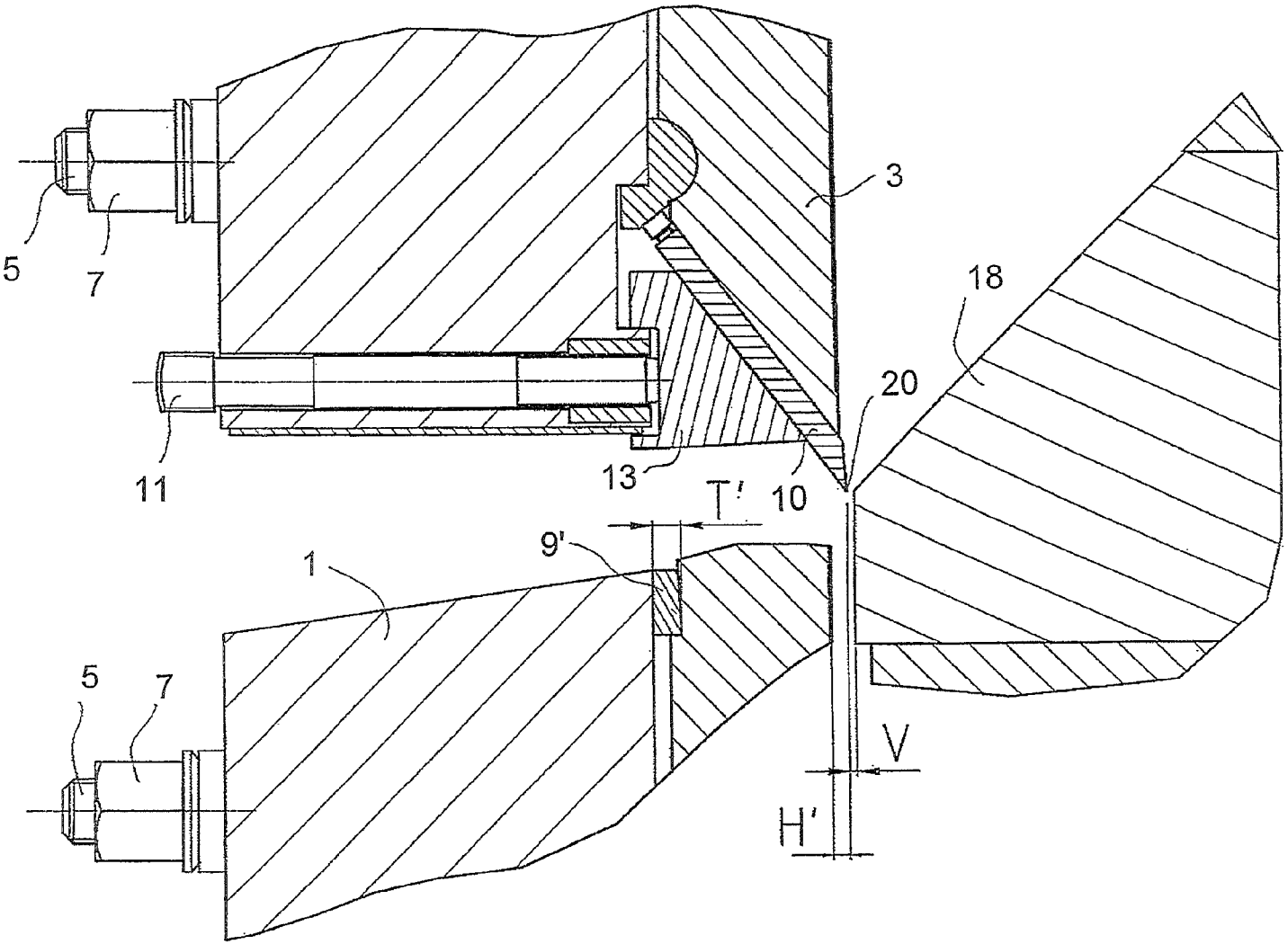
Fig. 2 Prior Art
Figure 3:
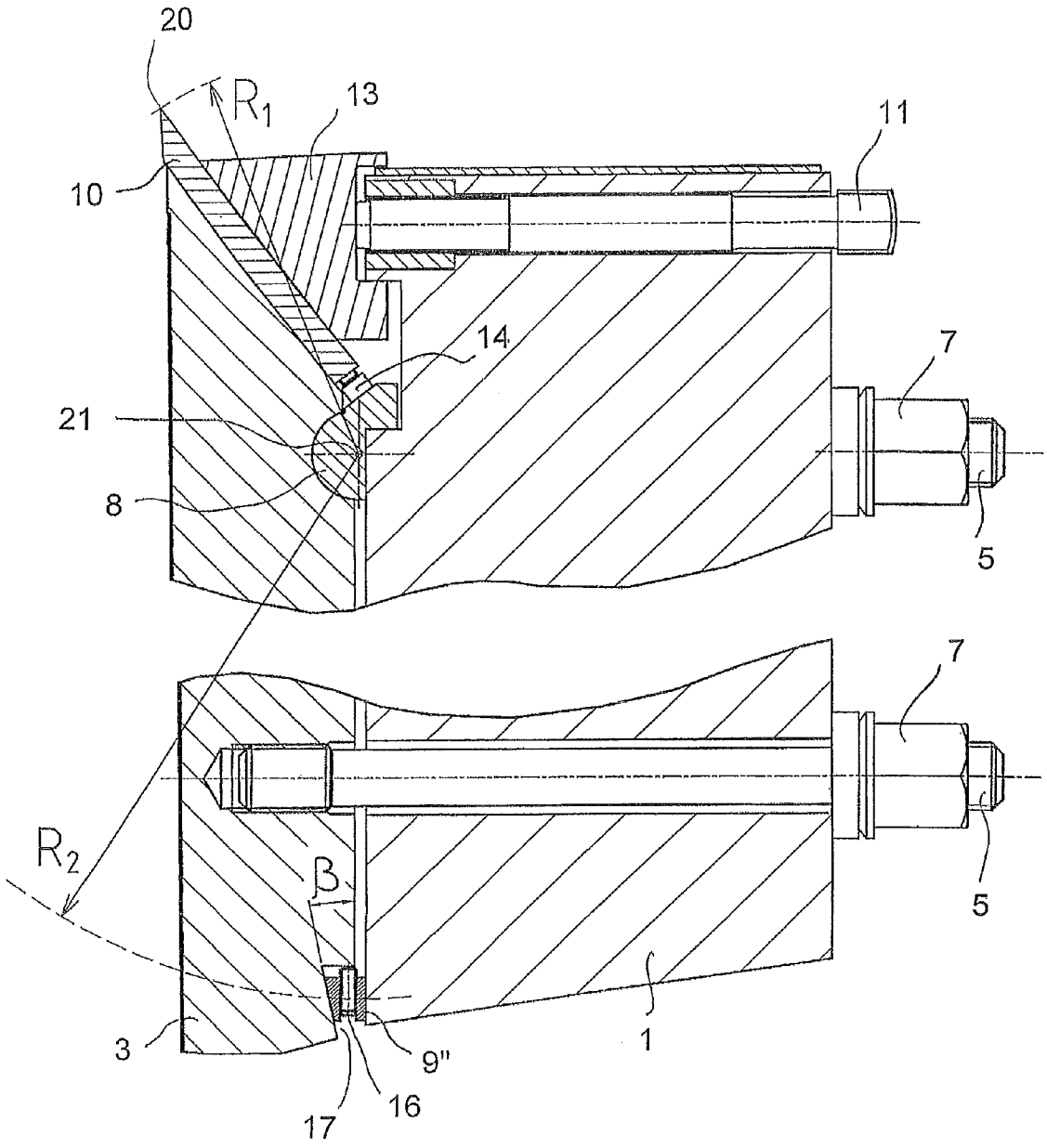

The invention and its details will be described in more detail in the following, with reference to the enclosed drawings, wherein FIG. 1 shows a cross-sectional view of one knife disc solution of prior art for a disc chipper, where an adjustable wear plate is used for clamping the knife, FIG. 2 shows a cross-sectional view of the chipper of FIG. 1 at the counter knife, FIG. 3 shows a chipper implementing the knife system in accordance with the invention.

Figure 4:
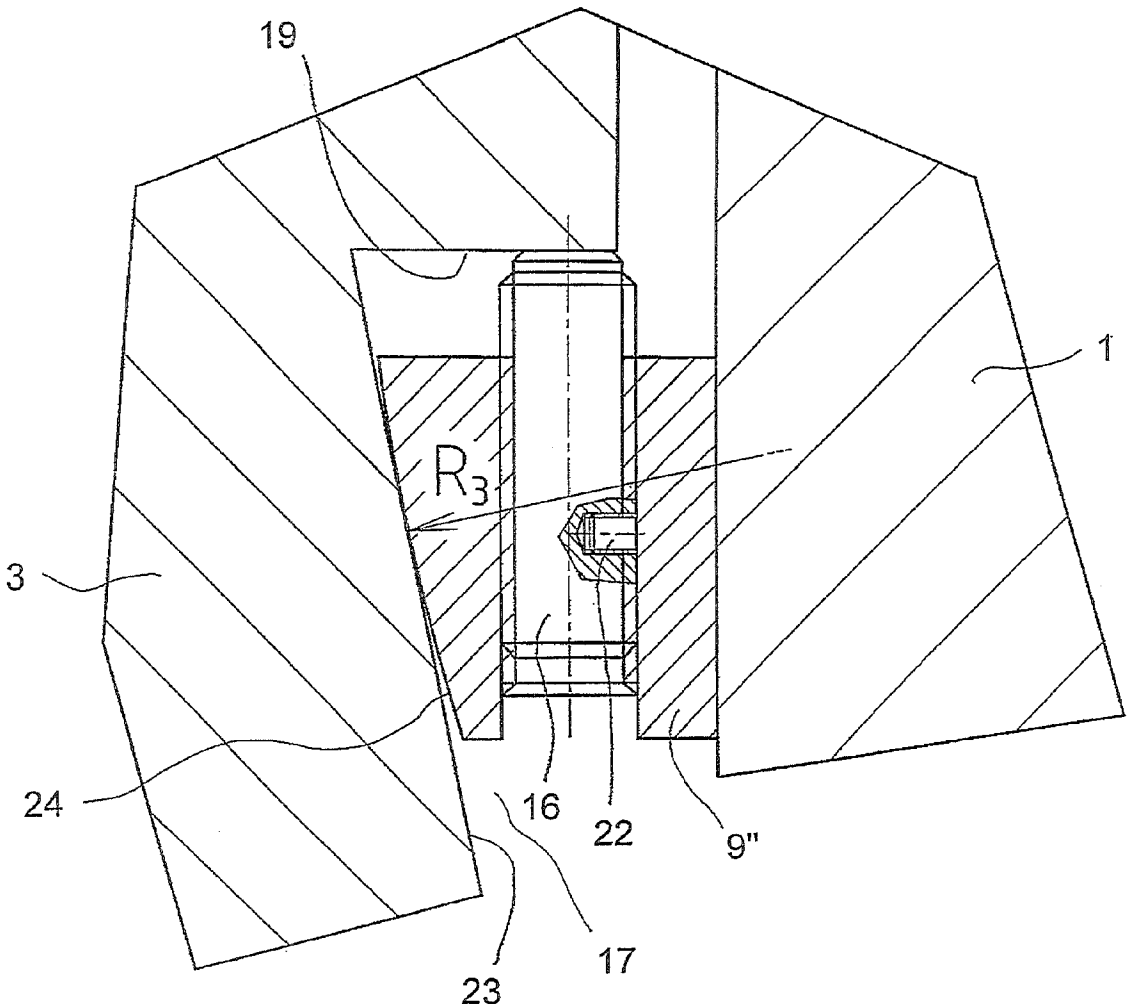

FIG. 4 shows a cross-sectional view of the adjustment strip at an adjustment screw.

A wear plate 3 covering the face area of the disc 1 from a knife 10 to the chip opening adjoining the next knife 10 is shown in a cross-sectional view of the disc 1 in FIG. 1, at three different points of the disc 1. Depending on the quantity of the knives, a bigger knife disc is usually provided with 8-16 wear plates. The wear plate 3 is attached to the knife disc with tap screws 5 and nuts 7. One wear plate has typically ten fixing screws 5. For adjusting the inclination of the wear plate relative to the disk, the wear plate 3 is abutted towards the knife disc 1 by means of a hinge strip 8 and a changeable adjustment strip 9. When changing an adjustment strip 9 to another strip of a different thickness T, the inclination of the wear plate 3 is altered when the wear plate turns its position around the hinge strip 8. With a thinner adjustment strip 9, the projection H of the knife 10 can be made bigger resulting to an increased chip length in operation.

When a knife 10 is fixed in place, it is pressed against the hinge strip 8 and clamped with screws 11. Only one screw is shown in the figure, but typically one knife 10 is attached in bigger chippers with six fixing screws 11. When tightened, the screws 11 are backing against the nuts 12 and exert a compressive force onto a press block 13 which clamps the knife against the wear plate 3.

The adjustable wear plate system is used for changing the dimension H, and respectively, the chip length in the operation of the chipper.

Even though the width S of a knife is carefully adjusted, the location of the tips 20 of the cutting edges of the knives 10 can be disadvantageously different from the intended plane shown by dashed line 15, the plane being perpendicular to the shaft of the disk. Said inaccuracy is resulting from manufacturing deviations. The width S of the knives is adjusted to a fixed value by means of screws 14 in the knife 10, before mounting them to the knife disc. The positions of the knife tips 20 attached to the knife disc are measured in general at two points on the length of the knife, by using a dial gauge attached to the chipper frame.

An example of one measurement in a realized chipper assembly was the following:

| Knife | at inner circle mm | at outer circle mm |
|---|---|---|
| 1. | 0.00 | 0.00 |
| 2. | −0.18 | −0.26 |
| 3. | 0.64 | 0.48 |
| 4. | 0.35 | 0.50 |
| 5. | 0.00 | −0.18 |
| 6. | 0.06 | 0.00 |
| 7. | −0.24 | −0.18 |
| 8. | 0.64 | 0.45 |
| 9. | 0.24 | 0.40 |
| 10. | 0.22 | 0.20 |
| 11. | 0.00 | 0.14 |
| 12. | 0.30 | 0.44 |
| 13. | 0.22 | 0.16 |
| 14. | 0.46 | 0.65 |
| 15. | 0.70 | 0.52 |

As shown by the results of the measurement, the difference between the tips of the outer most and the inner most knife can be 0.96 mm (knives 2 and 15).

FIG. 2 shows a cross-sectional view of the attachment of a knife in the assembly where the above measurement was effected. The view is taken on the opposite side of the knife disc, diaconal from the view of FIG. 1, where the knife is at the counter knife. The clearance V between the counter knife 18 and the outer most knife 10 is adjusted by moving the counter knife. The usual adjusting displacement for the counter blade is 0.5-0.8 mm, typically about 0.6 mm. Based on the above result of measurement, the knife clearance V will be set by means of the knife no 2. Thereby the knife clearance for a part of the knives will be more than one millimeter. At the inner circle, the clearance of knife 15 is as big as 1.56 mm.

The above clearance V measurements were effected at the unloaded state of chipper. The situation will change during the chipping, when the shaft and the knife disc bends and the other parts yield. The increased knife clearance V results to a lower chip quality, whereby also the tendency to formation of strings is increased.

By replacing the adjustment strip 9 shown in FIG. 1. by a thicker strip 9' of FIG. 2, (T'>T), the dimension H' will be smaller. The chip length is shortened, respectively. The desired change of the chip length is usually 2-4 mm. When the adjustment strip 9 is changed, also the knife clearance V must be checked, and if necessary, the distance of the counter knife 18 from the tip 20 of the outer most knife must be changed. Based on FIGS. 1 and 2, it may be concluded, that numerous parts of the system cause a prominent variation of the dimension V. A desired change of the chip length can be performed by changing the adjustment strip 9, 9'.

In the embodiment of the invention shown in FIGS. 3 and 4, the inclination position of the wear plate 3 and consequently the projecting distance of the tip 20 of the cutting edge of a knife can be adjusted steplessly by changing the position of a wedge-shaped adjustment strip 9" inserted into a wedge-shaped space 17 provided between the disk 1 and the relevant wear plate 3. The position of the adjustment strip 9" in the space 17 is determined by screws 16. The most advantageous accomplishment for the screws 16 in the adjustment strip 9" are one screw at a distance of about ⅕ of the length of the strip from both ends of the strip. The adjustment screw 16 must be fixed, for instance with a plug 22 shown in FIG. 4.

The wedge angle β of the wedge-shaped space 17 must be dimensioned so that an offset of +/−0.5 min is achieved at the tip 20 of the knife 10 with respect to the dimension V. In practice, the adjustment strip 9" can be moved by means of the screws 16 for about +/−5 mm. The surface 24 of the adjustment strip 9" has a big radius $R_3$ to provide a good contact against the surface 23 in all situations.

The precision adjustment of the knives is performed in practice as follows:

- Width S of the knives 10 to be attached to the chipper is adjusted by means of screws 14 with a dimensional accuracy of 0.1 mm.
- Adjustment strips 9" are set to the middle position for providing adjustment tolerance in both direction.
- The knives are mounted to the knife disc and all screws 11 are tightened to the same tightening torque.
- Positions of the knife tips 20 are measured at two points, in other words at the adjustment screws 16 (suitably at a distance of ⅕ from the knife ends).
- All measurement information is recorded.
- By means of the measurement results, the target level of the knife tips 20 is estimated.
- The actual adjustment is preferably made by means of a table drawn for this purpose, or a computer program made for this purpose. In that program, the pitch of thread of the adjustment screw 16, the angle β of the surface 17 of the wear plate, effective distance $R_2$ of the adjustment strip 9" and the distance $R_1$ of the tip 20 of the knife 10 from the central point 21 of the hinge 8 are taken into account.
- The results of the measurement are input to a computer that informs the need to adjust the adjustment screws 16, or the required adjustment is chosen from a chipper-specific table (adjustment direction and angle of turn of the screws 16).
- The nuts 7 of the tightening screws of the wear plates and the tightening screws 11 of the press block 13 are loosened.
- Adjustment screws 16 are turned, as necessary.
- Nuts 7 and tightening screws 11 are again tightened to the correct tightening torque.
- The adjustment is checked by performing the measurement of the projecting distance of the knives once more.
- Also after changing the knives, this correct projecting distance for the chipper knives is provided by making a proper width S adjustment at an accuracy of 0.1 mm
- The next adjustment according to the above mentioned program will be performed after the change of the wear plates 3 or after some other bigger maintenance.
- For this next adjustment the position of the adjustment screws 16 must be recorded so that each knife and adjustment screw has its own identification.

It has been discovered in the practice that the formation of strings can be avoided by using a clearance V=0.3-0.6 between the knife and the counter knife. This is provided by adjusting the widths S of the knives 10 until the tips 20 of all knives set to the desired level 15. This measure, however, increases the changing time of the knives, which is in general not available due to the big production demand.

The invention claimed is:

1. A knife system for a disc chipper, the disc including several chip openings trough the disc and a knife at each chip opening, each knife projecting from the respective opening on one side of the disc in a operation position, a wear plate for covering the knife side of the disc essentially on the area from one chip opening to the next one, a press block adjacent each chip opening, each press block being urged in the axial direction of the disc towards the respective wear plate for clamping a knife in said operation position between the respective wear plate and the press block, each wear plate being supported to the knife disc by means of a hinge strip located adjacent to the respective knife and an adjustment strip located in a space adjacent to the next chip opening for adjusting the inclination of the wear plate with respect to the surface of the knife disc, wherein the space provided for the adjustment strip is convergent towards the chip opening, the adjustment strip is correspondingly wedge-shaped and is furnished with position adjusting and locking means.

2. The knife system in accordance with claim 1, wherein the position adjustment of the adjustment strip in the space is provided by adjustment screws backing against the wear plate.

3. The knife system in accordance with claim 2, wherein there is one adjustment screw at each end of the adjustment strip at a distance of ⅕ the strip length from each end of the strip.

4. The knife system of a disc chipper in accordance with claim 3, wherein the distance of the wear plate from the surface of the knife disc at the adjustment strip is adjustable by means of position adjustment of the adjustment strip at a tolerance of +/−0.5 mm.

5. The knife system of a disc chipper in accordance with claim 2, wherein the distance of the wear plate from the surface of the knife disc at the adjustment strip is adjustable by means of position adjustment of the adjustment strip at a tolerance of +/−0.5 mm.

6. The knife system in accordance with claim 2, wherein there is one adjustment screw at each end of the adjustment strip.

7. The knife system of a disc chipper in accordance with claim 6, wherein the distance of the wear plate from the surface of the knife disc at the adjustment strip is adjustable by means of position adjustment of the adjustment strip at a tolerance of +/−0.5 mm.

8. The knife system of a disc chipper in accordance with claim 1, wherein the distance of the wear plate from the surface of the knife disc at the adjustment strip is adjustable by means of position adjustment of the adjustment strip at a tolerance of +/−0.5 mm.

* * * * *